US010680345B2

(12) United States Patent
Chahat et al.

(10) Patent No.: US 10,680,345 B2
(45) Date of Patent: Jun. 9, 2020

(54) HIGH-EFFICIENCY DUAL-BAND CIRCULARLY-POLARIZED ANTENNA FOR HARSH ENVIRONMENT FOR TELECOMMUNICATION

(71) Applicant: CALIFORNIA INSTITUTE OF TECHNOLOGY, Pasadena, CA (US)

(72) Inventors: Nacer E. Chahat, Pasadena, CA (US); Polly Estabrook, Pasadena, CA (US); Brant T. Cook, Pasadena, CA (US)

(73) Assignee: CALIFORNIA INSTITUTE OF TECHNOLOGY, Pasadena, CA (US)

( * ) Notice: Subject to any disclaimer, the term of this patent is extended or adjusted under 35 U.S.C. 154(b) by 48 days.

(21) Appl. No.: 16/223,070

(22) Filed: Dec. 17, 2018

(65) Prior Publication Data

US 2019/0190163 A1 Jun. 20, 2019

Related U.S. Application Data

(60) Provisional application No. 62/599,919, filed on Dec. 18, 2017.

(51) Int. Cl.
*H01Q 21/06* (2006.01)
*H01Q 9/04* (2006.01)
(Continued)

(52) U.S. Cl.
CPC ..... *H01Q 21/065* (2013.01); *H01Q 1/002* (2013.01); *H01Q 9/045* (2013.01); *H01Q 9/0421* (2013.01);
(Continued)

(58) Field of Classification Search
CPC ..... H01Q 1/002; H01Q 1/48; H01Q 1/50; H01Q 9/0407; H01Q 9/0414;
(Continued)

(56) References Cited

U.S. PATENT DOCUMENTS

2013/0113673 A1* 5/2013 Kyriazidou ..... H01Q 9/045 343/848
2016/0190869 A1* 6/2016 Shao ..... H02J 50/20 307/149
2019/0319366 A1* 10/2019 Mak ..... H01Q 21/065

OTHER PUBLICATIONS

Bray, M., et al., "A Radial Line Slot Array Antenna for Deep Space Missions", 2017 IEEE Aerospace Conference, Big Sky, MT., (2017). 6 Pages.

(Continued)

*Primary Examiner* — Robert Karacsony
(74) *Attorney, Agent, or Firm* — Steinfl + Bruno LLP

(57) ABSTRACT

An antenna for dual-band or wide-band communication link. The antenna includes a patch array, arranged above a top ground plane, that includes one or more panels, each panel included one or more patch subarrays, and each patch subarray includes single patch elements made from metal. Each patch element includes: a flat rectangular radiation surface element into which a rectangular cutout is formed; an RF power feed point having a cylindrical shape that makes contact to the bottom side of the radiation surface element and feeds through a hole formed in the top ground plane for connection to the RF power; and a structural post having a cylindrical shape that contacts, at one end, the bottom side of the radiation surface element at a region of the radiation surface element where electric surface current is substantially smaller than any other region, and contacts the top ground plane at a second end.

25 Claims, 12 Drawing Sheets

(51) Int. Cl.
*H01Q 21/00* (2006.01)
*H01Q 1/00* (2006.01)

(52) U.S. Cl.
CPC ..... *H01Q 9/0428* (2013.01); *H01Q 21/0025* (2013.01)

(58) Field of Classification Search
CPC .... H01Q 9/0421; H01Q 9/0428; H01Q 9/045; H01Q 21/0025; H01Q 21/0075; H01Q 21/0087; H01Q 21/064; H01Q 21/065; H01Q 21/30
See application file for complete search history.

(56) References Cited

OTHER PUBLICATIONS

Chamberlain, N. et al., "Juno Microwave Radiometer Patch Arrays Antennas", IEEE Antennas and Propagation Society International Symposium, APSURSI, (2009). 4 pages.
Gonzalez-Ovejero, D. et al., "Multibeam by Metasurface Antennas", IEEE Transactions on Antennas and Propagation, vol. 65, No. 6, pp. 2923-2930, (Jun. 2017). 9 pages.
Minatti, G. et al., "Modulated Metasurface Antennas for Space: Analysis: Synthesis, Analysis and Realizations", IEEE Transactions on Antennas and Propagation, vol. 63, No. 4, pp. 1288-1330, (Apr. 2015). 14 pages.
NASA/JPL, "Europa Lander Study 2016 Report, Europa Lander Mission", JPL D-97667, (Feb. 2017). 264 Pages.
Nasimuddin et al., "A Wideband Circularly Polarized Stacked Slotted Microstrip Patch Antenna", IEEE Antennas and Propagation Magazine, vol. 55, No. 6, pp. 84-99, (Dec. 2013).
Nayeri, P. et al., "Dual-Band Circularly Polarized Antennas Using Stacked Patched with Asymmetric U-Slots", IEEE Antennas and Wireless Propagation Letters, vol. 10, pp. 492-195, (2011).
Tong, K-F, et al., "Circularly Polarized U-Slot Antenna", IEEE Transactions on Antennas and Propagation , vol. 55, No. 8, pp, 2382-2385, (Aug. 2007).
Yang, F. et al., "Wide-Band E-Shaped Patch Antennas or Wireless Communications", IEEE Transactions on Antennas and Propagation, vol. 49, No. 7, pp. 1094-1100, (Jul. 2001). 7 pages.
Yang, S.L.S. et al., "Design and Study of Wideband Single Feed Circularly Polarized Microstrip Antennas", Progress in Electromagnetics Research, vol. 80, pp. 45-61, (2008).

* cited by examiner

100

200

308

420

308

HIGH-EFFICIENCY DUAL-BAND CIRCULARLY-POLARIZED ANTENNA FOR HARSH ENVIRONMENT FOR TELECOMMUNICATION

CROSS REFERENCE TO RELATED APPLICATIONS

The present application claims priority to U.S. provisional Patent Application No. 62/599,919 entitled "High-Efficiency Dual-Band Circularly-Polarized Antenna for Harsh Environment for Telecommunication", filed on Dec. 18, 2017, the disclosure of which is incorporated herein by reference in its entirety.

STATEMENT OF GOVERNMENT GRANT

The invention described herein was made in the performance of work under a NASA contract NNN12AA01C and is subject to the provisions of Public Law 96-517 (35 USC 202) in which the Contractor has elected to retain title.

TECHNICAL FIELD

The present disclosure relates to antennas. More particularly, it relates to high-efficiency dual-band and wide-band antennas that may be used, for example, in harsh environments for telecommunication.

BACKGROUND

It may be desirable to enable Direct-to-Earth (DTE) and Direct-from-Earth (DFE) links between, for example, Landers or Rovers and the Deep Space Network antennas, rather than relaying signals via a nearby spacecraft. Removing requirement for such nearby spacecraft can significantly reduce the cost of a mission, such as, for example, on Jupiter's icy moons. Based on currently known designs, such DTE and/or DFE links can require a large antenna aperture and a high transmitter power of at least 100 W. Such antenna must operate well at both an uplink frequency (e.g. 7.145-7.190 GHz) and a downlink frequency (e.g. 8.40-8.45 GHz) of for example, the Deep Space frequency bands, and must handle up to 100 W of input power in a vacuum.

Moreover, such antenna must operate well in harsh environment conditions, such as for example, Jupiter's icy moons environment which can present extreme challenges due to its high radiation and electrostatic discharge (ESD) levels and ultra-low temperatures. In addition to such harsh environment conditions, there may be tight volume constraints forcing the antenna to be completely flat and limiting its size. To withstand the harsh temperature conditions and radiation levels, the antenna should be made mainly of metal.

The maximum aperture area for the antenna may be limited, due, for example, to its disposition on Landers and/or Rovers, and therefore, a very high efficiency (e.g. >80%) antenna may be required to close the link from, for example, Jupiter's moons. Several antennas, such as radial line slot antennas (RLSA) (e.g. see Ref [2]) and metasurface antennas (e.g. see Refs. [3] and [4], have been considered but found not to meet the high efficiency requirements at both uplink and downlink frequencies. Researchers have investigated different approaches to obtain dual-band or wideband performance in circularly polarized (CP) patch antennas, including stacked patch antennas, slotted patch shapes, slotted ground planes, E-shaped, U-slot, L-shaped, and so on (e.g. see Refs. [5]-[9]). None of such approaches were found to be compatible with an all-metal solution that could potentially be scaled to a very large array.

Europa Lander (e.g. see Ref [1]) is a proposed NASA astrobiology concept mission for a lander to Europa, a moon of Jupiter which is thought to have a liquid ocean under its icy surface as well as water plumes. If selected and developed, the Europa Lander Mission may be launched soon to complement the science undertaken by the Europa Clipper mission. The objectives of the Europa Lander mission may be to search for biosignatures at the subsurface, to characterize the composition of non-ice near-subsurface material, and to determine the proximity of liquid water and recently erupted material near the lander's location. It is found that enabling DTE/DFE telecommunication links may substantially reduce the cost of the mission (e.g. from $4.5 B to $2.2B), as no carrier spacecraft with relay capabilities may be required.

Based on the above, there may be a need for an antenna to satisfy, for example, the dual-band communication link with NASA's Deep Space Network at the X-band frequency spectrum for future missions. Applicants of the present disclosure have established that such antenna may provide performance/design parameters that may include: i) meeting of stringent requirements across both uplink and downlink frequency bands with a sufficient thermal guard band; ii) a circularly polarized configuration; iii) an efficiency of higher than 80% at both frequency bands to provide at least a gain of 36.0 dBi (decibels-isotropic) and 37.1 dBi at 7.19 GHz and 8.425 GHz, respectively; iv) an axial ratio of the antenna of better than 3 dB; v) a return loss of the antenna to remain above 14 dB; vi) operation at temperatures down to 50K (~−223° C.) and high radiation levels; vii) being immune from electrostatic discharge (ESD); viii) handling of an input power of 100 W continuous wave in vacuum; and ix) a flat configuration and fit in a confined volume of, for example, 82.5×82.5×3 cm^3. It should also be noted that the antenna pointing to Earth in azimuth and elevation may be enabled by a mechanical gimbal known per se.

Accordingly, teachings according to the present disclosure describe an all-metal single patch element that can be used in a patch array to provide, for example, a high-efficiency dual-band or wide-band circularly-polarized antenna for telecommunication in harsh environment that satisfy the above performance/design parameters.

SUMMARY

According to one embodiment the present disclosure, an antenna is presented, the antenna comprising: a metal top ground plane; a patch array arranged above the top ground plane, the patch array comprising a plurality of single patch elements made from metal, wherein each single patch element of the plurality of single patch elements comprises: a flat radiation surface element having a rectangular shape into which a rectangular cutout is formed; an RF power feed point comprising a first cylindrical structure that contacts at one end of the first cylindrical structure a bottom side of the flat radiation surface element, and feeds through a corresponding hole formed in the metal top ground plane for connection to the RF power at a second end of the first cylindrical structure; and a structural post comprising a second cylindrical structure that contacts at one end of the second cylindrical structure the bottom side of the radiation surface element at a region of the radiation surface element where an electric surface current is substantially smaller compared to an electric surface current in other regions of the radiation surface element, and contacts the top ground plane at a second end of the second cylindrical structure.

According to a second embodiment of the present disclosure, a method for producing an antenna is presented, the method comprising: providing a metal top ground plane; and providing a patch array comprising a plurality of single patch elements made from metal; arranging the patch array above the top ground plane via contacting of a respective structural post of each single patch element of the plurality of single patch elements to the top ground plane, wherein, each single patch element of the plurality of single patch elements comprises: a flat radiation surface element having a rectangular shape into which a rectangular cutout is formed; an RF power feed point comprising a first cylindrical structure that contacts at one end of the first cylindrical structure a bottom side of the flat radiation surface element, and feeds through a corresponding hole formed in the metal top ground plane for connection to the RF power at a second end of the first cylindrical structure; and the structural post comprising a second cylindrical structure that contacts at one end of the second cylindrical structure the bottom side of the radiation surface element at a region of the radiation surface element where an electric surface current is substantially smaller compared to an electric surface current in other regions of the radiation surface element, and contacts the top ground plane at a second end of the second cylindrical structure.

Further aspects of the disclosure are shown in the specification, drawings and claims of the present application.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

Figure 1:
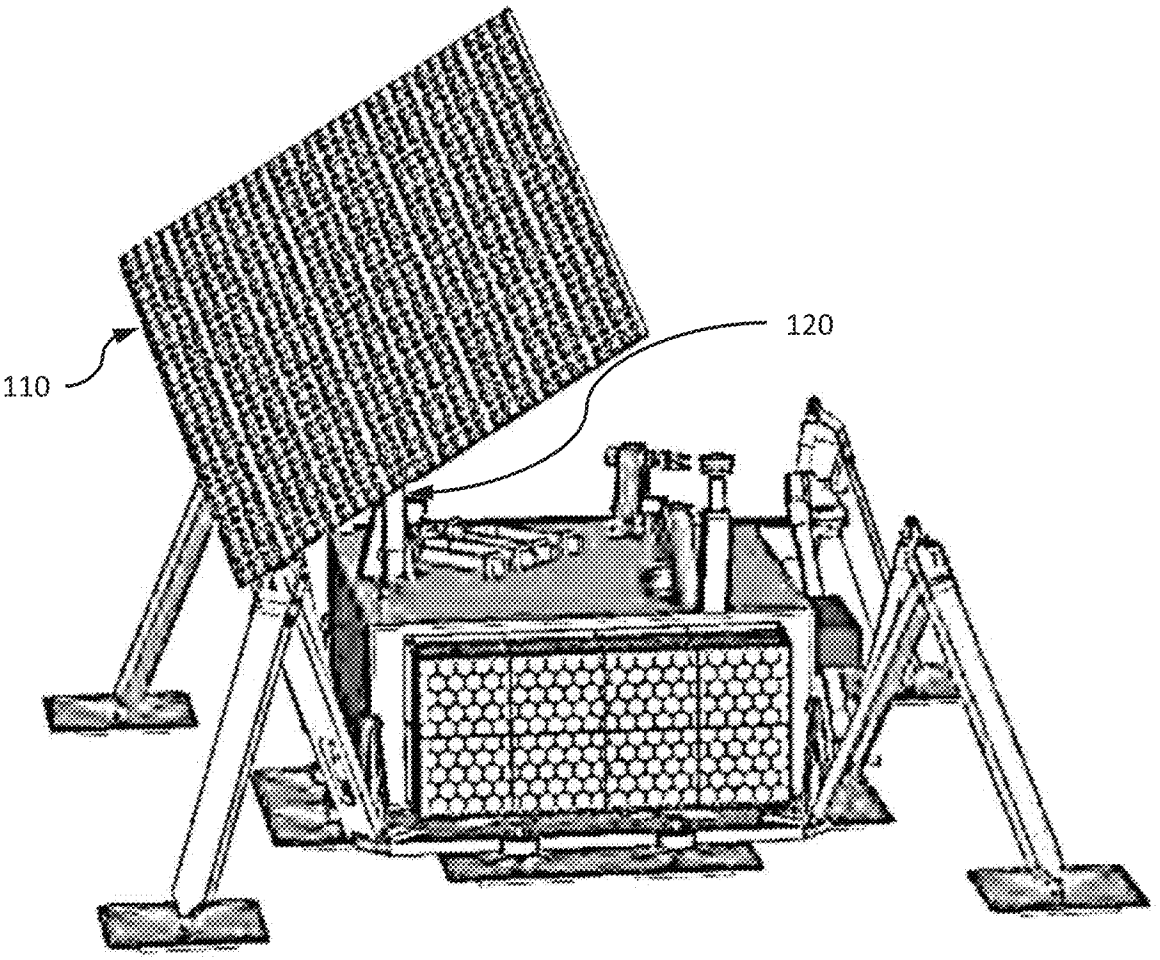
FIG. 1 shows an exemplary lander/rover fitted with the antenna according to an embodiment of the present disclosure in a deployed configuration.

FIG. 1 shows an exemplary lander/rover fitted with an exemplary antenna (110) according to the present disclosure. The antenna (110) may be, for example, a high-efficiency dual-band or wide-band circularly polarized antenna based on a novel antenna design that includes a right hand circular polarized (RHCP) patch array comprising all-metal single patch elements. The exemplary antenna (110) can provide an efficiency of more than 80% at both the uplink frequency (e.g. 7.145-7.190 GHz) and the downlink frequency (e.g. 8.40-8.45 GHz). In general, even though an exemplary implementation of a dual-band antenna is described in the present disclosure, it should be noted that the antenna according to the present teachings can provide operate over a wide frequency spectrum, of for example, 1 GHz to 10 GHz and more, with similar high efficiency. As it is well known to a person skilled in the art, in the present context efficiency is based on a measure of the electrical efficiency with which a radio antenna converts the radio-frequency (RF) power accepted at its terminals into radiated power.

The exemplary dual-frequency RHCP antenna (110) leverages construction methods developed for the Juno MicroWave Radiometer single-frequency LP patch array antennas (e.g. see Ref [10]). The exemplary antenna (110) may be a dual-band RHCP high gain antenna with an all-metal top surface that may be used as a Deep Space DTE/DFE antenna in future missions for space exploration in harsh environments.

To satisfy dual-band communication link specifications at the X-band, the antenna (110) may be configured to meet requirements across both uplink and downlink frequency bands with a sufficient thermal guard band to ensure maximum performance over a large temperature range. The antenna (110) may be circularly polarized and have an efficiency that is higher than 80% at both uplink and downlink frequency bands to provide at least a gain of 36.0 dBi and 37.1 dBi at 7.19 GHz and 8.425 GHz, respectively. The antenna (110) may have an axial ratio that is better (i.e., lower in value) than 3 dB and a return loss that remains above 14 dB during operation.

The antenna (110) can operate at temperatures down to 50K (~−223° C.) and at high radiation levels and is immune from electrostatic discharge (ESD). The antenna (110) can handle an input power of at least 100 W continuous wave in vacuum. Finally, as shown in FIG. 1, the antenna (110) can be flat and designed to fit (when not fully deployed/unfolded) in a confined volume of, for example, 82.5×82.5×3 cm^3. If desired, the antenna (110) can have a surface that is not necessarily flat so to conform to a shape of an object to be mounted on. As shown in FIG. 1, a mechanical gimbal (120) coupled to the antenna (110) may be used to enable pointing of the antenna (110) to Earth in azimuth and elevation.

Figure 2A:
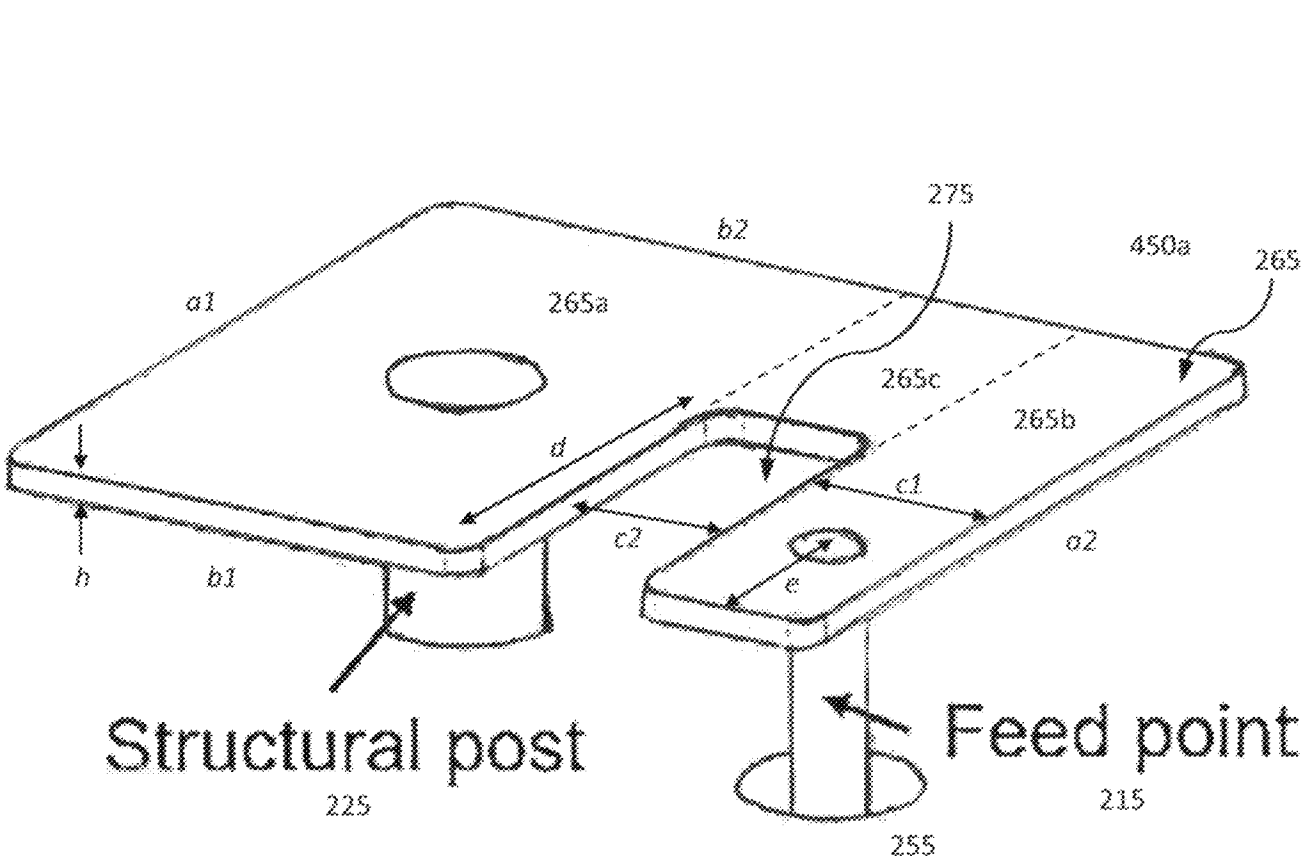
FIG. 2A shows a top side perspective view of a single patch element according to an embodiment of the present disclosure.

FIG. 2A shows a top side perspective view of an all-metal single patch element (200) according to an embodiment of the present disclosure that is used as a basis of the patch array of the antenna (110). In other words, as it is later described, an array comprising a plurality of the single patch element (200) is used as a radiating surface of the antenna (110). The single patch element (200) can provide RHCP at both the uplink and the downlink frequency bands.

As shown in FIG. 2A, the single patch element (200) is a single-fed element that uses a single feed point (215) to provide RF power to the single patch element (200) to simplify not only a feeding network to the patch array of the antenna (110) but also fabrication and assembly of the antenna (110). A person skilled in the art would clearly understand that in the present context, the RF power may be provided by an excitation RF signal that is fed to the feed point (215) of the single patch element (200) so that the single patch element (200) converts the RF power to radiated power.

According to an embodiment of the present disclosure, the single patch element (200) is entirely made of a high conductivity metal, such as, for example, aluminum, and is grounded to an antenna (top) ground plane (450*a*) through a structural post (225). According to an exemplary embodiment of the present disclosure, the single patch element (200) is made (machined) as a single block. According to a further exemplary embodiment of the present disclosure, the single patch element (200) and the (top) ground plane (450*a*) are made of a same material. According to a further embodiment of the present disclosure, in order not to affect a performance of the antenna (110), the structural post (225) is located in a region of the single patch element (200) where electric surface current is small, or substantially smaller, than the electric surface current in other regions of the single patch element (200). Such location can be determined via software simulation and analysis based on readily available tools and methods that may take into account material and geometry/shape of the single patch element (200). Geometry/shape of the single patch element (200) may be optimized in a patch array comprising an infinite number of single patch elements (200) to obtain the required axial ratio and impedance of the antenna (110). Once the performance of the single patch element (200) is met, its performance in a patch array of finite single patch elements (200), such as, for example, a patch array of 32×32 elements (200), may be verified.

Applicants of the present disclosure have found that that a wire such as the structural post (225) can be connected to the single patch element (200), at a location where relatively very low surface currents flow, and then connected to the ground plane (450*a*) without impacting the radiation pattern of the antenna (110). It was further found that the circular polarization performance of the antenna (110) benefits from the structural post (225) presence. Furthermore, this allows to use the structural post (225) to support (suspend) the patch element (200) above the ground plane (450*a*), thus eliminating the use of dielectric. Not using dielectric as supporting element of the patch element (200) improves the bandwidth of the antenna (110) and makes the antenna more resistant to harsh environment (low or high temperature, or high radiation level). This also mitigates the risk of delamination during thermal cycling as no bonding material between two materials of different coefficient of thermal expansion (CTE) is used. Furthermore, as large antennas may be susceptible to issues related to acoustic loads during launch, sizing the structural post (225) properly allows mitigating such issues. According to an exemplary embodiment of the present disclosure, a size (e.g. diameter of the cylindrical shape) of the structural post (225) may be at least 10% of a width or length (dimensions of a1, a2 or b1, b2 of FIG. 2A) of the patch element (200).

As can be seen in FIG. 2A, the single patch element (200) includes a substantially flat radiation surface element (265) of a (substantially) rectangular shape or square shape into which a (substantially) rectangular cutout (275) is formed.

According to some embodiments of the present disclosure, a thickness h of the radiation surface element (265) may be in a range between 0.9 mm to 1.1 mm, such as, for example, 1.0 mm. According to an exemplary embodiment of the present disclosure, lengths of sides (a1, a2, b1, b2) of the radiation surface element (265) may each be in a range between 15.0 mm and 20.0 mm. Such exemplary lengths may provide for a compact area of the radiation surface element (265). Such compact area, when coupled with a spacing/distance between the single patch elements (200) when arranged as an array, may allow fitting of the antenna (110) within an allocated volume of, for example, 82.5×82.5×3 cm^3.

With further reference to FIG. 2A, according to an embodiment of the present disclosure, the lengths of sides (a1, a2, b1, b2) of the radiation surface element (265) may be based on a frequency of operation of the antenna (110). According to an embodiment of the present disclosure, such lengths may be in a range between 40% and 60% of a wavelength in free space (i.e., free space wavelength) at the frequency of operation. In a case of a dual-band antenna, such frequency of operation may be selected to be the higher frequency of the dual-band, and in a case of a wide-band antenna, such frequency of operation may be selected to be a center frequency of operation based on lower and higher cutoff frequencies.

The following Table I shows dimensions/lengths of the all-metal single patch element (200) according to a preferred embodiment of the present disclosure suitable, for example, for use in a patch array of an antenna for dual-band communication at an uplink frequency of 7.19 GHz and a downlink frequency of 8.425 GHz:

TABLE I

| Parameters | Dimensions (mm) |
|---|---|
| $a_1$, $a_2$ | 15.6 |
| d | 8.8 |
| e | 3.7 |
| $b_1$, $b_2$ | 17.3 |
| $c_1$ | 1.9 |
| $c_2$ | 3.5 |
| Total height | 4.1 |

where the total height of the single patch element (200) refers to the distance from the top surface of the radiation surface element (265) to the bottom surface of the feed point (215) shown in FIG. 2B (later described).

As can be seen in FIG. 2A, the rectangular cutout (275) longitudinally extends from an edge of a side b1 of the radiation surface element (265) toward an opposite (and parallel) side b2 of the radiation surface element (265) and is parallel to sides (a1, a2) of the radiation surface element (265). According to a preferred embodiment of the present disclosure, a long side d of the rectangular cutout (275) has a length that is in a range between 40% and 70%, and more particularly between 50% and 60%, of a length of parallel sides (a1, a2) of the radiation surface element (265), and a short side c2 of the rectangular cutout (275) has a length that is in a range between 15% and 35%, and more particularly between 15% and 25%, of a length of parallel sides (b1, b2) of the radiation surface element (265). According to another preferred embodiment of the present disclosure, the rectangular cutout (275) is arranged at a distance c1 from an edge of the side a2 of the radiation surface element (265) that is in a range between 15% and 35%, and more particularly 15% and 25%, of the length of the parallel sides (b1, b2).

It should be noted that such preferred geometries of the single patch element (200) shown in the above Table I have been established by Applicants of the present disclosure via the above-mentioned software simulation and analysis in view of the required performance of the patch array of the antenna (110) according to the present teachings for said uplink and downlink frequencies of 7.19 GHz and 8.425 GHz respectively. It is to be understood that different geometries of the single patch element (200) optimized for different frequencies of operation may be obtained while maintaining a shape of the single patch element shown in FIG. 2A with geometries/lengths that are within the above described ranges (ratios). In other words, starting from lengths of the sides (a1=a2, b1=b2), other dimensions may be ratiometrically derived and further optimized in view of an operating frequency.

With continued reference to the single patch element (200) of FIG. 2A, the feed point (215) has a substantially cylindrical shape that protrudes vertically from a bottom side of the radiation surface element (265) for connection, through a hole (255) formed in the top ground plane (450*a*), to an air stripline feed network (4B of FIG. 4B) positioned underneath the top ground plane (450). Furthermore, as can be seen on FIG. 2A, the structural post (225) has a substantially cylindrical shape that protrudes vertically from the bottom side of the radiation surface element (265) for connection to the top ground plane (450*a*). As described above, the structural post (225) makes contact to the radiation surface element (265) of the single patch element (200) at a region of the radiation surface element (265) where the electric surface current is (substantially) null (smaller) when compared to the electric surface current in other regions of the radiation surface element (265). According to an exemplary embodiment of the present disclosure, a diameter of the cylindrical structure of the feed point (215) is in a range between 0.8 mm to 1.2 mm, and a diameter of the cylindrical structure of the structural post (225) is in a range between 4.5 mm to 5.5 mm, such as, for example, 5.0 mm. According to a further embodiment of the present disclosure, the cylindrical structure of the structural post (225) may be hollow so to decrease total weight of the single patch element (200). According to a further embodiment of the present disclosure, a height of the patch elements (200) over the top ground plane (450*a*), and therefore a height of the structural post (225), is selected to achieve a required bandwidth of the antenna (110).

As can be seen in FIG. 2A, the feed point (215) and the structural post (225) make contact to the bottom side of the radiation surface element (265) at different sides of the rectangular cutout (275). Assuming that the rectangular cutout (275) defines two full width regions (265*a*, 265*b*) of the radiation surface element (265) and a reduced width region (265*c*), according to an embodiment of the present disclosure shown in FIG. 2A, the feed point (215) makes contact with the full width region (265*b*) and the structural post (225) makes contact with the full width region (265*a*), wherein a surface area of the full width region (265*a*) is larger (almost by a factor of two) with respect to a surface area of the full width region (265*b*).

With further reference to FIG. 2A, according to an exemplary embodiment of the present disclosure, the structural post (225) contacts the radiation surface element (265) at a substantially center region of the full width region (265*a*). According to a further exemplary embodiment of the present disclosure, the feed point (215) contacts the radiation surface element (265) at a region of the full width region (265*b*) that is away from the reduced width region (265*c*) and proximate the rectangular cutout (275). According to an exemplary embodiment of the present disclosure, a center of the feed point (215) is arranged centrally along a shorter side of the full width region (265*b*) and at a distance e from the edge of the side b1 of the radiation surface element (265) that is in a range between 10% and 30%, and more particularly 15% and 25%, of the length of sides a1, a2 of the radiation surface element (265).

Figure 2B:
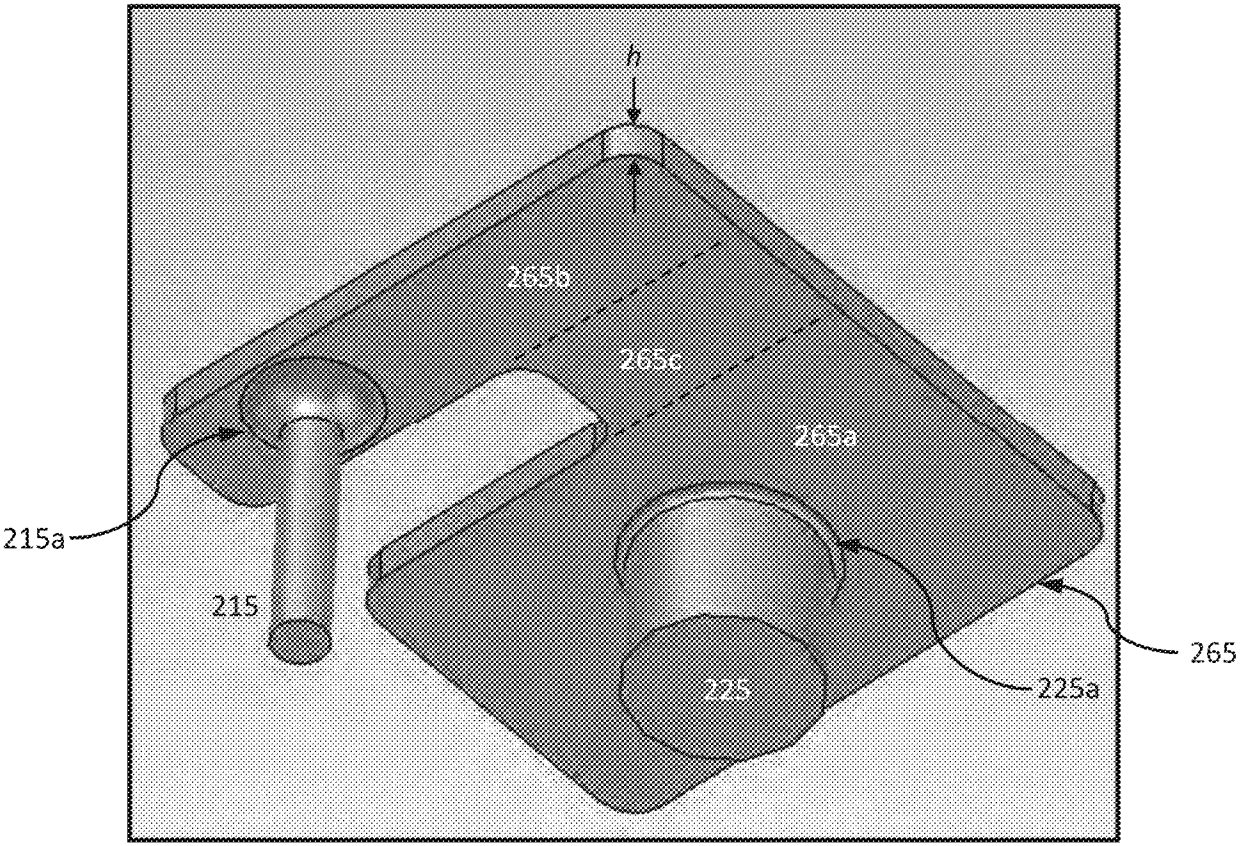
FIG. 2B shows a bottom side perspective view of the single patch element.

FIG. 2B shows a bottom side perspective view of the single patch element (200) described above. According to an exemplary embodiment of the present disclosure, and as shown in FIG. 2B, one or both of the feed point (215) and the structural post (225) may include a respective edge bend radius (215*a*, 225*a*) at a region of contact with the bottom side of the radiation surface element (265). According to an exemplary embodiment of the present disclosure the edge bend radius (215) is about 1.5 mm and the edge bend radius (225*a*) is about 0.25 mm.

Figure 3:
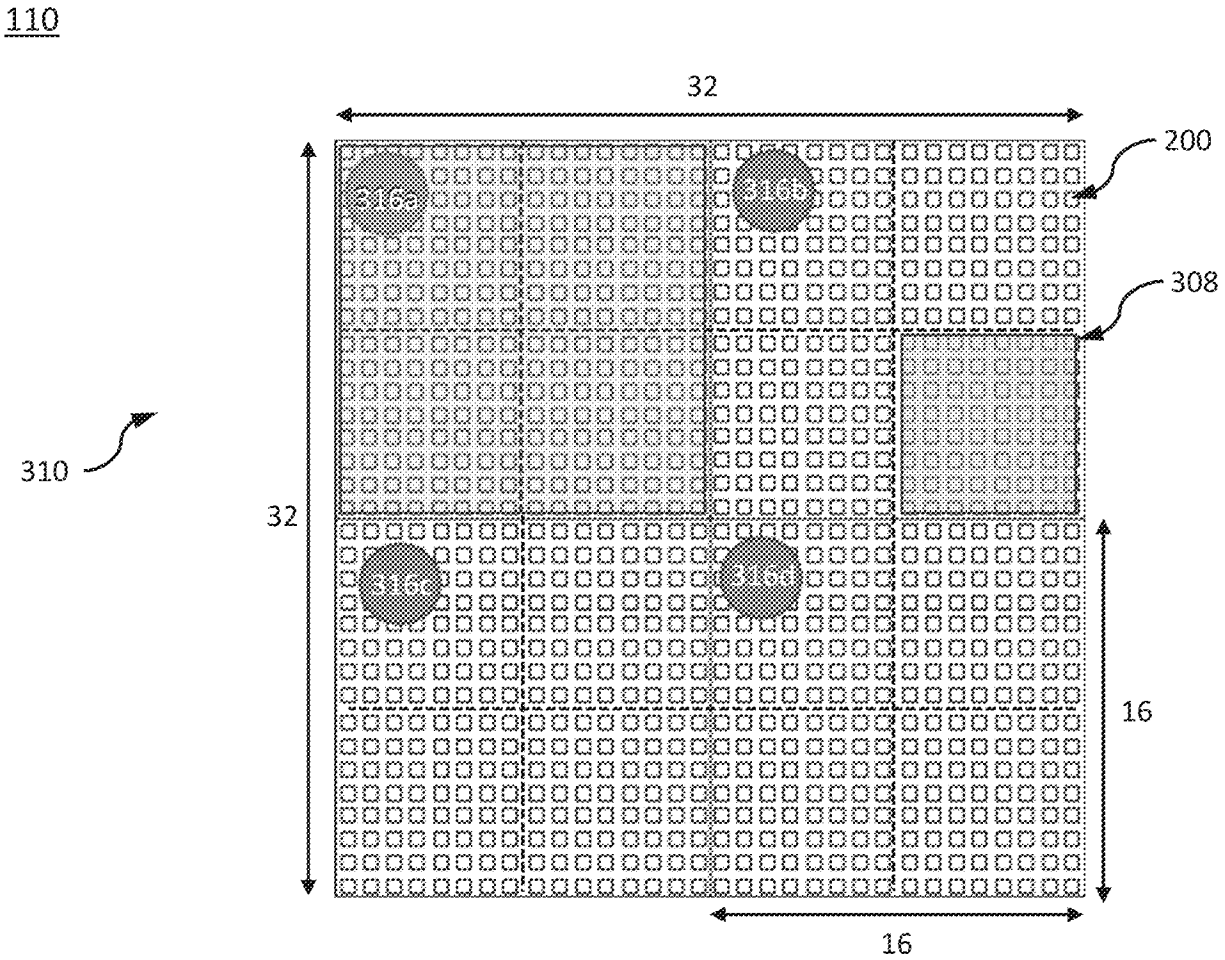
FIG. 3 shows a deployable 32×32 patch array of the antenna according to an embodiment of the present disclosure.

According to an exemplary embodiment of the present disclosure, as shown in FIG. 3, the antenna (110) may include a patch array (310) having a size of, for example, 32×32 single patch elements (200). According to a further exemplary embodiment of the present disclosure, the patch array (310) may be deployable, in other words, the antenna (110) may include an array (310) of, for example, 32 lines and 32 columns of single patch elements (200) that can be folded and unfolded. According to an exemplary embodiment of the present disclosure, as shown in FIG. 3, the folding and unfolding of the patch array (310) may be provided by dividing the patch array (310) into, for example, four (movable/pivotable/deployable) panels (316*a*, 316*b*, 316*c*, 316*d*). According to a further exemplary embodiment of the present disclosure, each of the four panels (316*a*, 316*b*, 316*c*, 316*d*) may be divided into, for example, four 8×8 patch subarrays (308), each configured to be fed RF power via a single input terminal.

It should be noted that the sizes of the patch array (310) (e.g. 32×32), the panels (316) (e.g. 16×16) and the subarrays (308) (e.g. 8×8) should be considered as design parameters that may be based, for example, on a maximum radiating power and/or deploy ability or not of the antenna (110). A person skilled in the art would clearly be able to use the all-metal single patch element (200) according to the present teachings to design an antenna, including a reflector antenna, having a patch array of any size, such as, for example, 2×2, 2×4, 4×4 and N×M where N and M are integer numbers. Accordingly, such antenna may include a single fixed patch array made of N×M single patch elements (200) and having a single RF input power terminal (e.g. 422 of FIG. 4B). In other words, the patch array (310) may include a single panel (316) which may include a single subarray (308) of N×M single patch elements (200). It should be understood that division of the patch array (310) of the antenna (110) according to one or more panels (e.g. 316) and one or more subarrays (e.g. 308) are mere implementation examples in view of potential design goals, such as, for example, radiating power of the antenna and/or size/volume of the antenna.

Figure 4A:
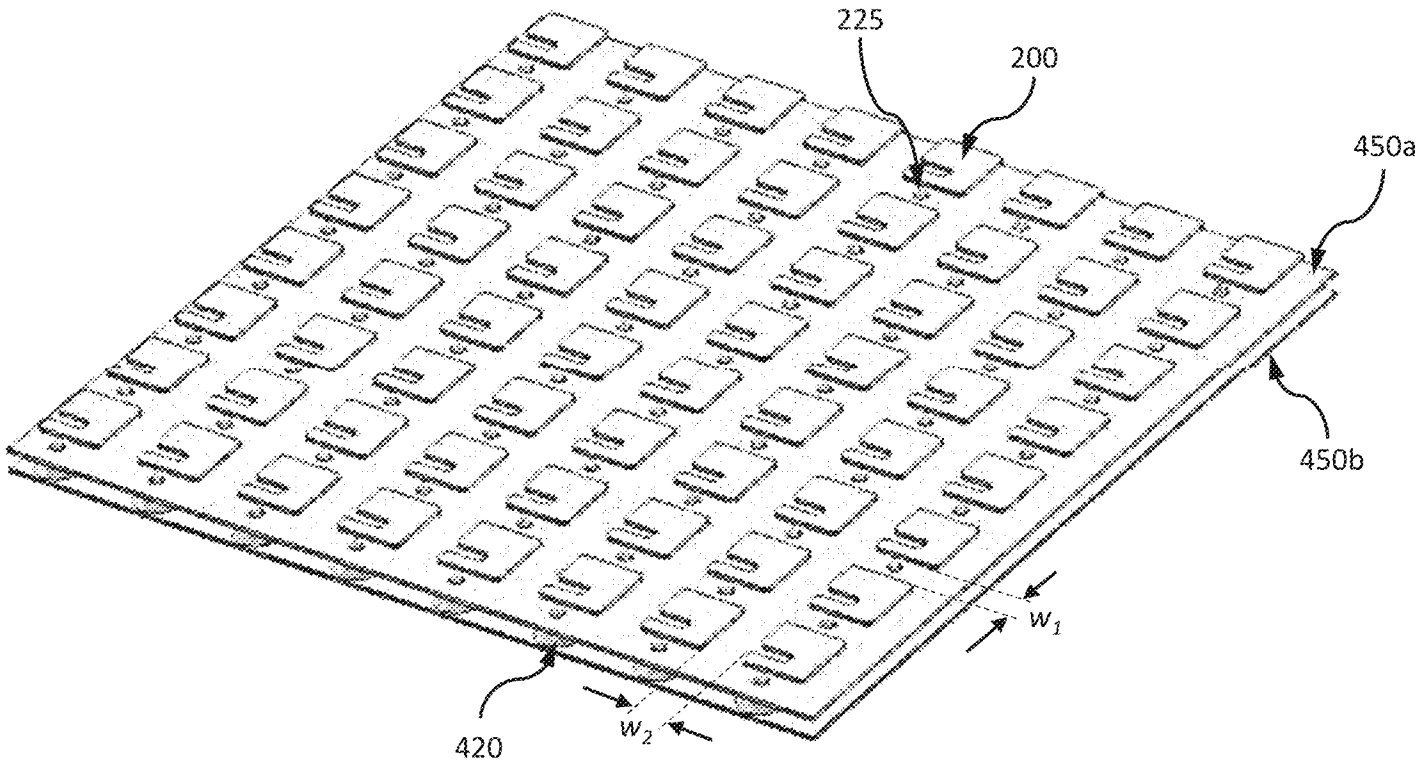
FIG. 4A shows a structure of an 8×8 patch subarray according to an embodiment of the present disclosure.

FIG. 4A shows a structure of the exemplary 8×8 patch subarray (308), comprising 64 single patch elements (200) arranged as an array of 8×8, each single patch element (200) mounted, via a corresponding structural post (225), on a top ground plane (450*a*) of the 8×8 subarray (308). Holes (255 of FIG. 2A) though the top ground plane (450*a*) allow routing of RF power to each of the single patch elements (200) via a corresponding feed point (215 of FIG. 2A). According to an exemplary embodiment of the present disclosure, the feed point (215) may be connected to an air stripline feed network (420), shown in FIG. 4B, that is arranged between the top ground plane (450*a*) and a bottom ground plane (450*b*) of the 8×8 patch subarray (308) shown in FIG. 4A. According to an exemplary embodiment of the present disclosure, the top ground plane (450*a*) and the bottom ground plane (450*b*) may be made of a high conductivity metal, such as, for example, aluminum, and have a thickness in a range between 1.25 mm and 1.75 mm, such as, for example, 1.5 mm. According to a further embodiment of the present disclosure, the top ground plane (450*a*), the bottom ground plane (450*b*) and the single patch element (200) are made of a same material.

With continued reference to FIG. 4A, according to an exemplary embodiment of the present disclosure, spacings (w1, w2) between any two single patch elements (200) may be in a range between 0.35 to 0.75 (35% to 75%) of a free space wavelength at the frequency of operation (e.g. uplink, downlink). For example, as can be clearly understood by a person skilled in the art, for an uplink frequency of 7.19 GHz, the free space wavelength is 3·10^8/7.19·10^9≈4.2 cm, and for a downlink frequency of 8.425 GHz, the free space wavelength is 3·10^8/8.425·10^9≈3.6 cm, and therefore the spacings (w1, w2) can be, for example, in a range between 0.35×3.6=1.26 cm and 0.75×4.2=3.15 cm. Alternatively, the spacings (w1, w2) can be based only on the higher frequency band (e.g. 8.425 GHz), and therefore be in a range between 0.35×3.6=1.26 cm and 0.75×3.6=2.7 cm. Suh spacing may allow for a reduced total surface area of the patch subarray (308) so as to fit the antenna (101) within a limited space/volume. It should be noted that in view of larger available space/volume, the spacings (w1, w2) may be selected to be larger, and outside the above exemplary range, without degradation in performance of the antenna (110). As related to the dimensions of the sides (a1, a2) and (b1, b2) of the patch element (200), such dimensions may also be based on the higher frequency band (e.g. 8.425 GHz) and in a range between 0.40 to 0.60 of a corresponding free space wavelength. Therefore, dimensions of the sides (a1, a2) and (b1, b2) of the patch element (200) may be in a range between 1.4 cm to 2.1 cm.

Figure 4B:
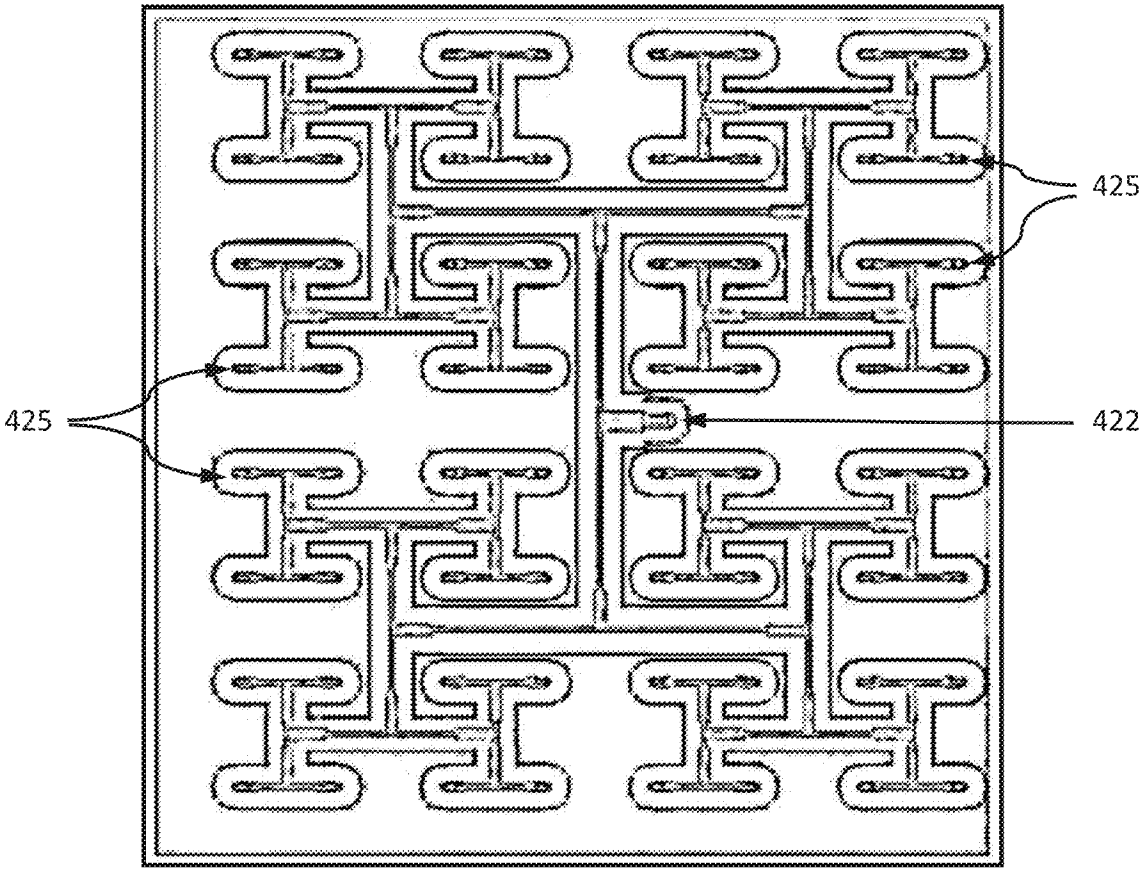
FIG. 4B shows an air stripline feed network according to an embodiment of the present disclosure.

FIG. 4B shows an exemplary air stripline feed network (420) that may be arranged between the top ground plane (450*a*) and the bottom ground plane (450*b*) of the 8×8 patch subarray (308). As can be well understood by a person skilled in the art, the air stripline feed network (420) can provide an equal amount of RF power (e.g. equimagnitude and equiphase) to each of the single patch elements (200) of the 8×8 patch subarray (308) with very low loss. Such RF power loss through the air stripline feed network (420) can be, for example, less than 0.2 dB. According to an embodiment of the present disclosure, thickness of stripline elements that make the air stripline feed network (420) in combination with a distance between the top and bottom ground planes (450*a*, 450*b*) are chosen to provide sufficient margin against multipaction or ionization breakdown. According to an exemplary embodiment of the present disclosure, such thickness of the stripline elements in combination with the distance between the top and bottom ground planes may provide a margin of more than 20 dB against multipaction. According to an exemplary embodiment of the present disclosure, the distance between the top ground plane and the bottom ground plane may be in a range between 1.5 mm to 5.00 mm, such as, for example, 4.00 mm.

It should be noted that usage of an air stripline network as described above with reference to FIG. 4B may be beneficial in cases where the antenna (110) may be used in harsh environments, including, for example, cryogenic temperatures and/or radiation levels, that can affect dielectric properties of a dielectric material used in conventional stripline networks known to a person skilled in the art. Accordingly, conventional stripline networks may be used in combination with the antenna according to the present teachings if the antenna is not to be deployed in such harsh environments. A person skilled in the art would clearly realize other benefits provided by the above described air stripline by virtue of not using a dielectric material, such as, for example, reduced losses in the power divider, and hence increase in the antenna efficiency.

With further reference to FIG. 4B, according to an embodiment of the present disclosure, the feed point (215 of FIG. 2A) of each of the single patch elements (200 of FIG. 4A) is connected to an RF feed point (425) of the air stripline feed network (420). It should be noted that due to the symmetrical nature of the 8×8 patch subarray (308) of FIG. 4A, a similar and corresponding symmetry can be provided for the air stripline network (420) as shown in FIG. 4B. According to an embodiment of the present disclosure, RF power to the air stripline network (420) may be provided via a single RF input power terminal (422) that may be positioned, for example, as shown in FIG. 4B, in a center of symmetry of the air stripline network (420). Such center of symmetry may provide equal length of stripline segments between the RF input power terminal (422) and each of the RF feed points (425) for equal RF power and phase distribution to each of the single patch elements (200 of FIG. 4A). According to a non-limiting exemplary embodiment of the present disclosure, the input power terminal (422) may be suitable for connection to an SMA type connector. According to a further embodiment of the present disclosure, such input power terminal (422) may be machined as a single block.

Figure 4C:
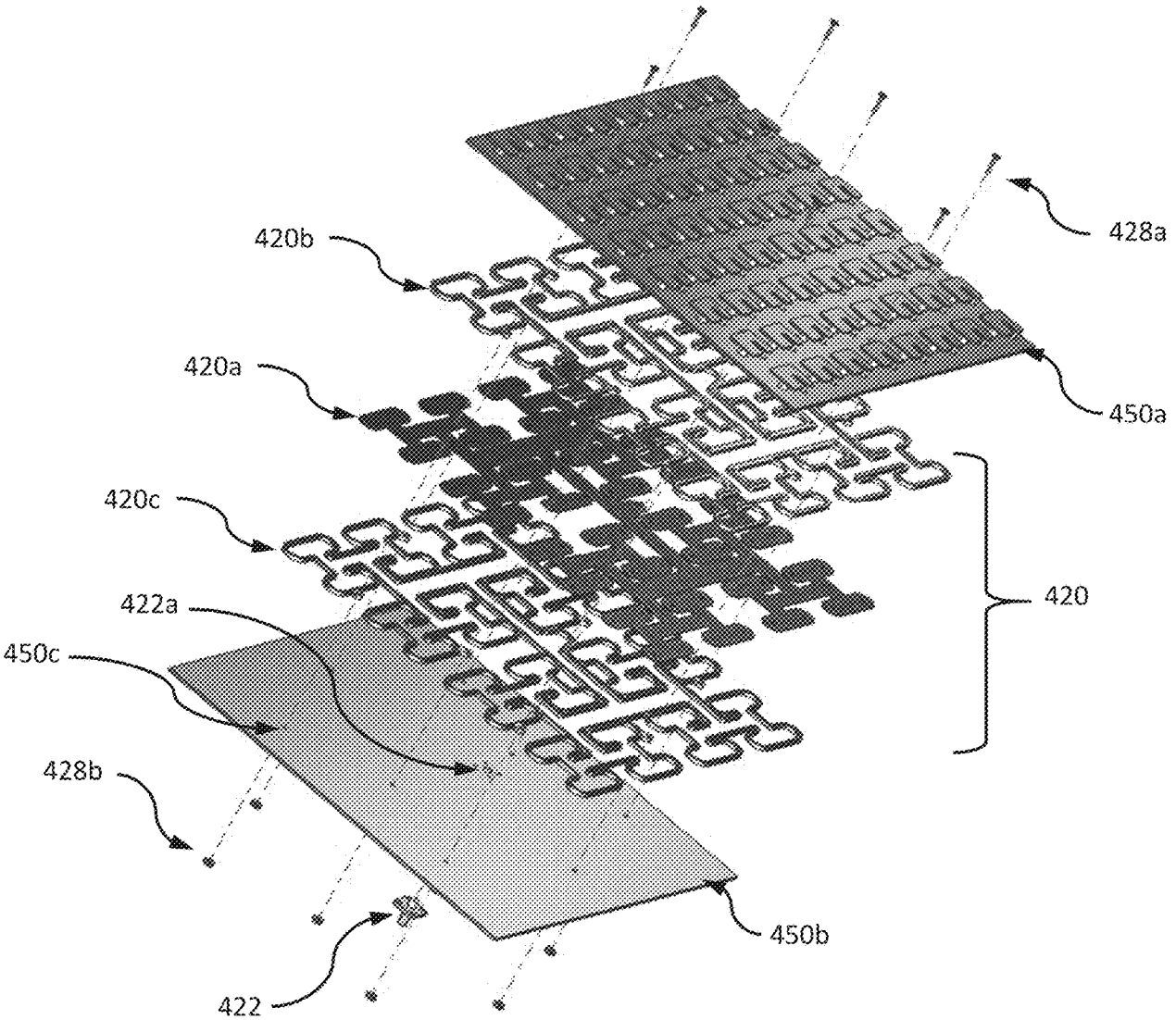
FIG. 4C shows an exploded view of the 8×8 patch subarray shown in FIG. 4A.

FIG. 4C shows an exploded view of the exemplary 8×8 patch subarray (308). A person skilled in the art would appreciate the simplicity of the design of such subarray which can allow for a simple and cost-efficient assembly. As can be seen in the exploded view of FIG. 4C, the top ground plane (450*a*), having the elements (200) mounted thereupon, and bottom layer (450*b*), sandwich the air stripline feed network (420). Accordingly, the patch of elements (200) is suspended above the top ground plane (450*a*) by the structural posts (225) of the patch elements (200). Such structural posts (225) may provide electrical conduction between the patch of elements (200) and the ground plane (450*a*). Furthermore, top wall (420*b*) and bottom wall (420*c*) of the air stripline feed network (420) sandwich and maintain in place a suspended substrate board (420*a*) of the air stripline feed network (420) within which RF power is conducted. Fasteners (428*a*, 428*b*), such as for example bolts (428*a*) and nuts/washers (428*b*) may be used to assemble the exemplary 8×8 patch subarray (308) by feeding, for example the bolts (428*a*) through holes (450*c*) formed in the top/bottom ground planes (450*a*, 450*b*) and in the air stripline feed network (420). As shown in FIG. 4C, the single RF input power terminal (422) may be mounted onto a backside of the bottom ground plane (450*b*) away from the air stripline feed network (420) via a mounting hole (422*a*) with conductive leads passing through such mounting hole and terminating onto the air stripline feed network (420). According to an exemplary embodiment of the present disclosure, the air stripline feed network (420) may be fabricated using a well-known in the art R04003C laminate structure.

Figure 5:
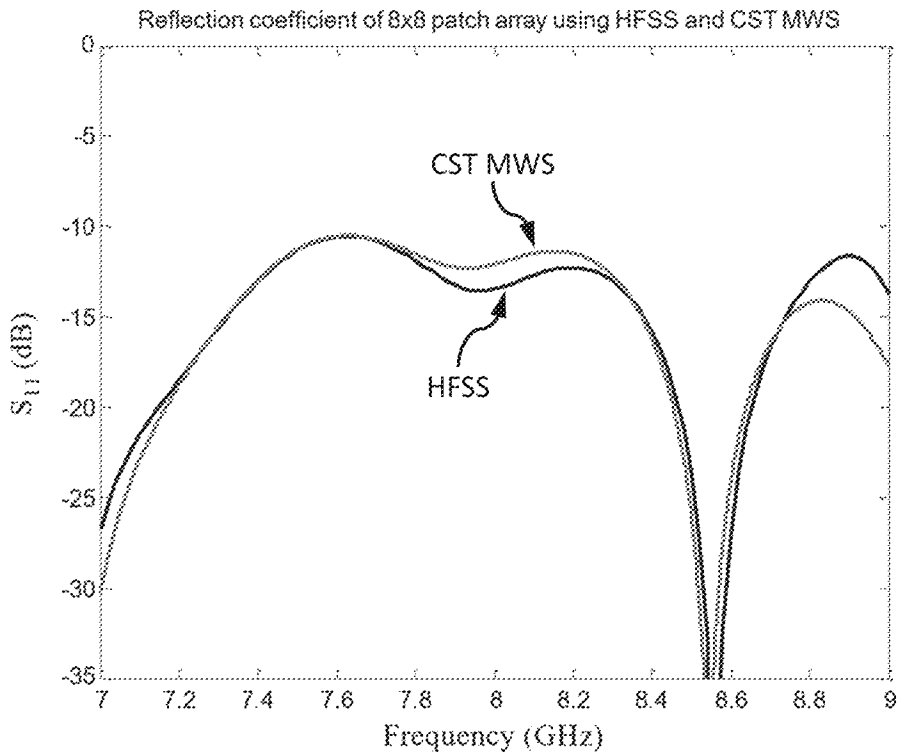
FIG. 5 shows graphs representative of a reflection coefficient of the 8×8 patch subarray as a function of frequency.
Figure 6B:
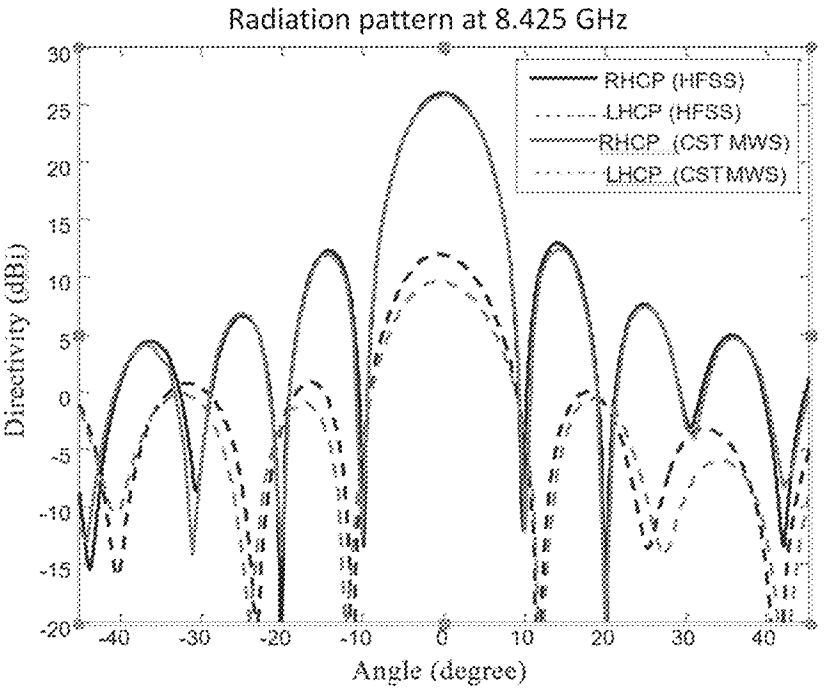
FIG. 6B shows a graph representative of a directivity in dBi of the 8×8 patch subarray at a downlink frequency of 8.425 GHz.
Figure 6A:
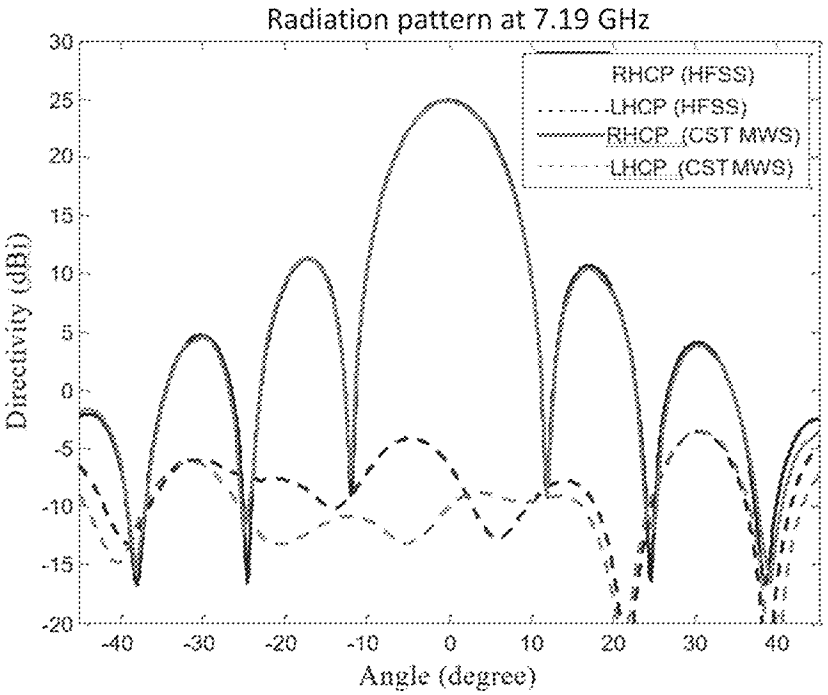
FIG. 6A shows a graph representative of a directivity in dBi of the 8×8 patch subarray at an uplink frequency of 7.19 GHz.

Based on a prototype of the above described exemplary 8×8 patch subarray (308), Applicants of the present disclosure have measured, and graphed in FIG. 5, a reflection coefficient $S_{11}$ of such subarray that as shown in FIG. 5 is below −10 dB at a frequency range of 7 GHz to 9 GHz. Directivity in dBi of the radiation pattern of the subarray (308) at the uplink frequency 7.19 GHz and the downlink frequency 8.425 GHz is respectively shown in FIG. 6A and FIG. 6B. Excellent agreement is found between measurements obtained on the prototype and simulation using CST MWS and HFSS for the reflection coefficient and the radiation pattern. The maximum insertion loss of the subarray (308) is assessed to be roughly 0.3 dB which translates into 93% efficiency. The antenna directivity, gain, and axial ratio are shown in Table II:

TABLE II antenna directivity (dBi), gain (dBi) and axial ratio (dB) of the 8 × 8 patch subarray (308):

| Frequency | Directivity (dBi) | | Gain (dBi) | | Axial Ratio (dB) | |
|---|---|---|---|---|---|---|
| (GHz) | Calc. | Meas. | Calc. | Meas. | Calc. | Meas. |
| 7.1675 | 24.9 | 24.9 | 24.5 | 24.1 ± 0.4 | 0.3 | 0.3 |
| 8.425 | 26.0 | 26.0 | 25.6 | 25.3 ± 0.4 | 2.7 | 2.2 |

Figure 7:
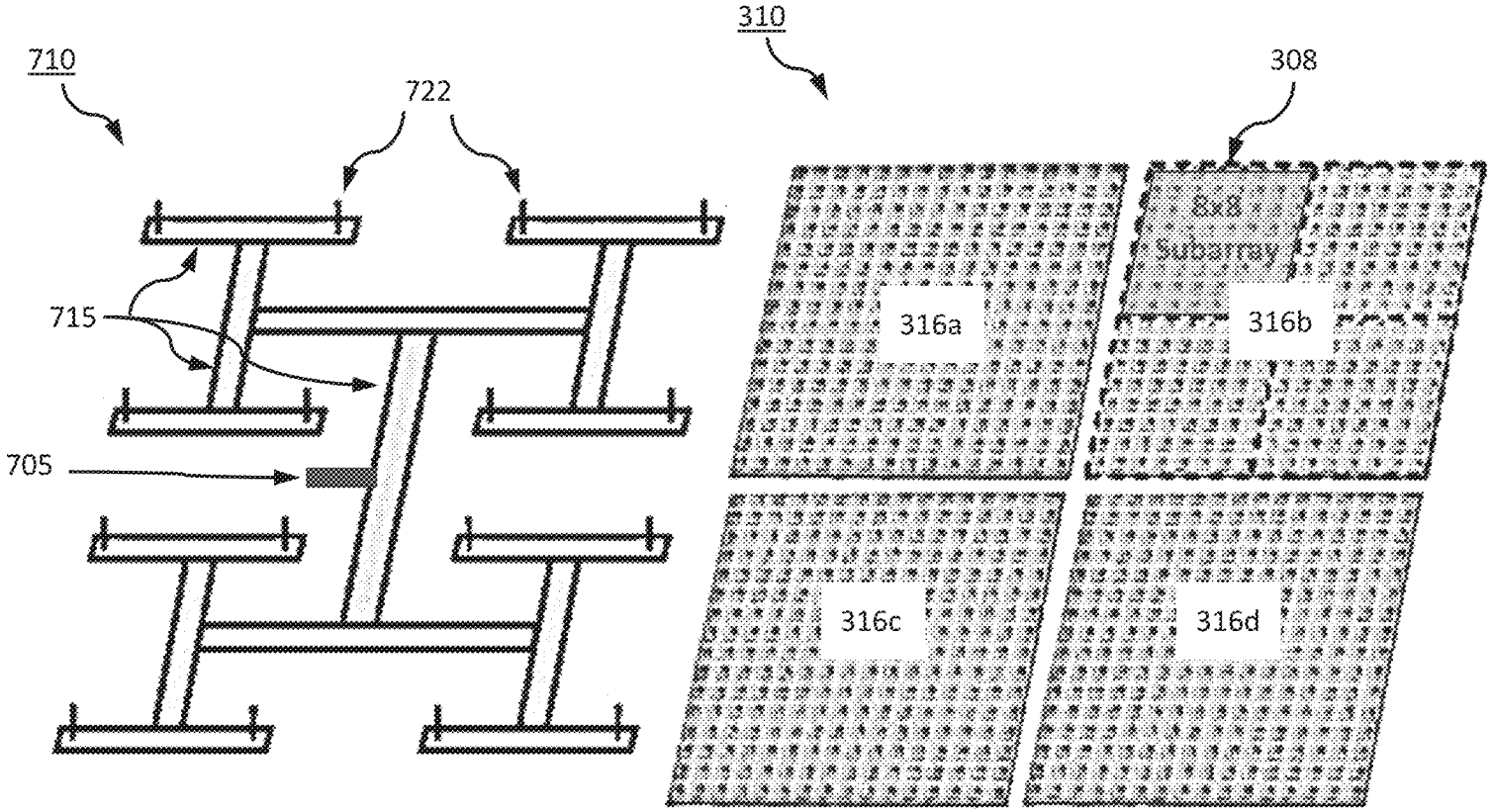
FIG. 7 shows an exemplary embodiment according to the present disclosure of a waveguide structure that provides RF power to the 8×8 patch subarrays from a single input RF to the waveguide structure.

According to an embodiment of the present disclosure, a (symmetrical) waveguide structure positioned beneath the 32×32 patch array (310) of the antenna (110) may be used to provide RF power to each of the four panels (316*a*, 316*b*, 316*c*, 316*d*). FIG. 7 shows an exemplary embodiment of such waveguide structure (710) where connectors (722) positioned at extremities of a segments (715) of the waveguide structure (722) may be used to provide RF power to each of the 8×8 subarrays (308) of each of the four panels (316*a*, 316*b*, 316*c*, 316*d*). According to an exemplary embodiment of the present disclosure, the connectors (722) may be in the form of probes that fit into a profile (housing) of the RF input power terminals (422) of the 8×8 subarrays (308) described above with reference to FIG. 4B.

According to a non-limiting exemplary embodiment of the present disclosure, the waveguide structure (710) (i.e., segments 715 thereof) may be of the WR-112 type. Dividing, via the waveguide structure (710), of an input RF power provided at an input (705) of the waveguide structure (710) and feeding portions of such RF power to each of the individual 8×8 subarrays (308) may allow the antenna (110) to support high input RF power levels. For example, and with further reference to FIG. 4B, for an input RF power of 100 W provided at the input (705) of the waveguide structure (710), the RF power seen at each of the RF input power terminals (422) of the air stripline network (420) is only 6.25 W.

Figure 8:
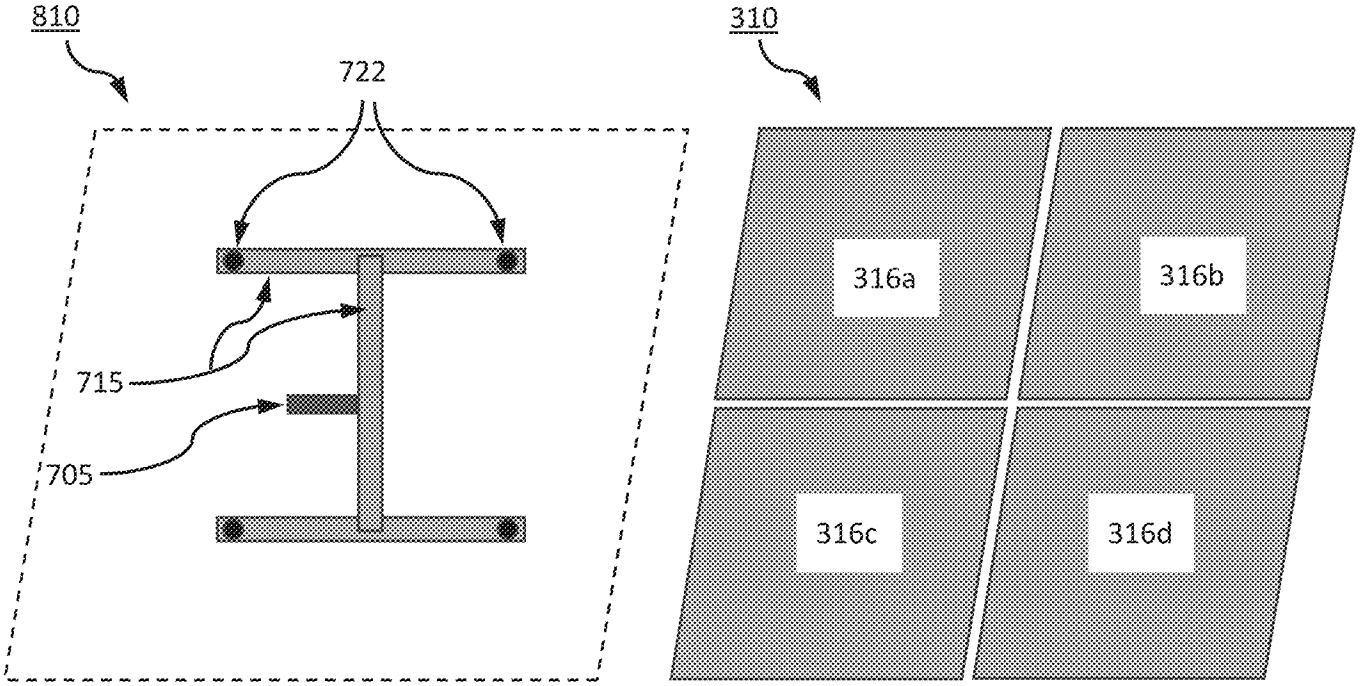
FIG. 8 shows another exemplary embodiment according to the present disclosure of a waveguide structure.

A person skilled in the art would appreciate the simple yet efficient and scalable architecture provided by the antenna (110) described above. The simple matching network provided by the waveguide structure (710) to the air-stripline network (420) may be modified according to a desired scaling of the antenna (110). For example, if desired, the matching network may be adapted to distribute the input RF power at the input (705) to the four panels (316*a*, 316*b*, 316, c, 316*d*) via a single connector (722) per such panel, as shown in FIG. 8. In the exemplary configuration according to the present disclosure shown in FIG. 8, the input RF power provided at the input (705) is divided into four RF power levels by the waveguide structure (810) and each of the four divided portions of the input RF power is routed to each of the panels (316*a*, 316, 316*c*, 316*d*). A person skilled in the art would clearly understand that in such configuration, the air stripline feed network of each of the panels (316*a*, 316, 316*c*, 316*d*) may be a scaled-up version of the air stripline feed network (420) of FIG. 4B. For example, according to non-limiting exemplary embodiment according to the present disclosure, such air stripline network may include four air stripline feed network (420) of FIG. 4B interconnected according to a symmetrical arrangement.

Figure 9:
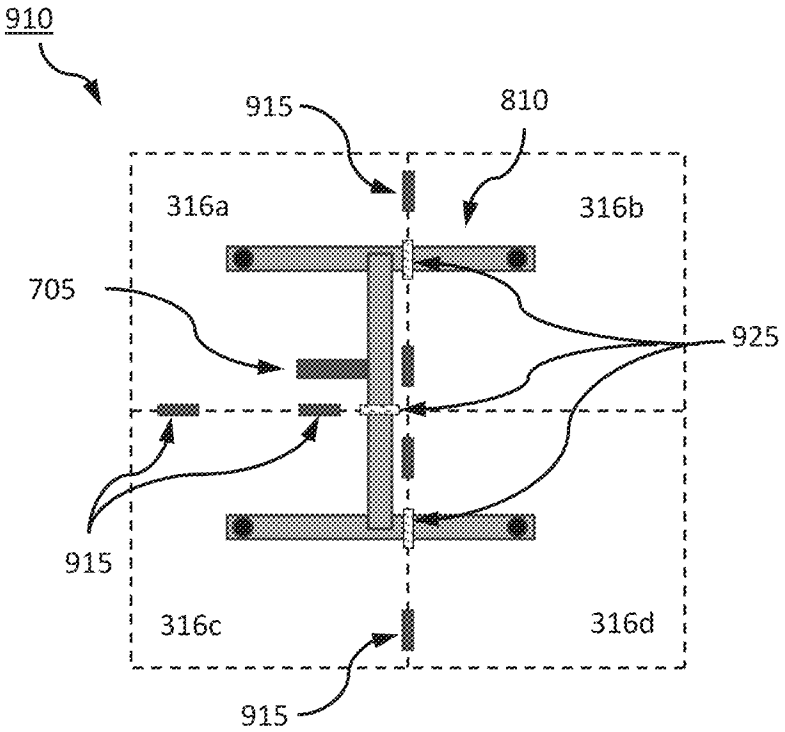
FIG. 9 shows an assembly of the antenna according to an embodiment of the present disclosure.

FIG. 9 shows an assembly (910) of an exemplary deployable antenna (110) according to the present teachings. Hinges (915), such as for example damped hinges, placed at edges of the panels (316*a*, 316*b*, 316*c*, 316*d*) allow folding of the panels for a reduced volume occupied when the antenna (110) is not deployed. According to an exemplary embodiment of the present disclosure, panels (316*b*, 316*c*, 31*d*) may be deployable panels and the panel (316*a*) may be a fixed panel. Accordingly, the deployable panels (316*b*, 316*c*, 31*d*) may be folded onto, for example, the fixed panel (316*a*) via the hinges (915). According to another exemplary embodiment of the present disclosure, waveguide chokes (925), also known as choke joints or rotating joints, may be placed in regions of seams created between the panels (316*b*, 316*c*, 31*d*) so to allow rotation of segments of the waveguide structure (810). As known to a person skilled in the art the waveguide chokes (925) can restrict undesired RF leaks from the waveguide structure (810) and therefore allow continuity between different segments (715) of the waveguide structure (810) with little power loss. More description on such assembly (910) can be found, for example, in Ref [10].

Based on the above described embodiments, the antenna (110) of the present disclosure can provide gain of more than 36.0 dBi and 37.1 dBi at the uplink and downlink frequency bands, respectively, and efficiencies in a range of 80% to 90% (compared to prior art efficiencies in the range of about 40%). The antenna (110) can also sustain high radiation levels, large temperature changes, and harsh ESD requirements. The performance of the antenna will remain stable in such harsh environments. The antenna (110) can also be compact is size (about 1 $m^2$ when fully deployed) and relatively light (about 10 Kg in weight). It should be noted that although arrays of limited number of single patch elements (200) are described above, design techniques of the antenna (110) according to the present teachings can be equally applied to larger or smaller size arrays in view of, for example, specific volume constraints.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The references in the present application, shown in the reference list below, are incorporated herein by reference in their entirety.

REFERENCES

[1] NASA/JPL, "Europa Lander study 2016 report, Europa Lander Mission", JPL D-97667, February 2017.

[2] M. Bray, "A radial line slot array antenna for deep space missions," 2017 IEEE Aerospace Conference, Big Sky, Mont., 2017.

[3] D. Gonzalez-Ovejero, G. Minatti, G. Chattopadhyay and S. Maci, "Multibeam by metasurface antennas," IEEE Trans. Antennas Propag., vol. 65, no. 6, pp. 2923-2930, June 2017.

[4] G. Minatti, M. Faenzi, E. *Martini*, F. Caminita, P. De Vita, D. Gonzalez-Ovejero, M. Sabbadini, and S. Maci, "Modulated metasurface antennas for space: synthesis, analysis and realizations," IEEE Trans. Antennas Propag., vol. 63, no. 4, pp. 1288-1300, April 2015.

[5] P. Nayeri, K.-F. Lee, A. Z. Elsherbeni, and F. Yang, "Dual-band circularly polarized antennas using stacked patches with asymmetric U-slots," IEEE Antennas Wireless Propag. Lett., vol. 10, pp. 492-495, 2011.

[6] Nasimuddin, X. Qing, and Z. N. Chen, "A wideband circularly polarized stacked slotted microstrip patch antenna," IEEE Antennas Propag. Mag., vol. 55, no. 6, pp. 84-99, 2013.

[7] F. Yang, X. Zhang, X. Ye, and Y. Rahmat-Samii, "Wideband E-shaped patch antennas for wireless communications," IEEE Trans. Antennas Propag., vol. 49, no. 7, pp. 1094-1100, 2001.

[8] K.-F. Tong and T.-P. Wong, "Circularly polarized U-slot antenna," IEEE Trans. Antennas Propag., vol. 55, pp. 2382-2385, August 2007.

[9] S. S. Yang, K. Lee, A. A. Kishk, and K. Luk, "Design and study of wideband single feed circularly polarized microstrip antennas," Prog. Electromagnet. Res., vol. 80, pp. 45-61, 2008.

[10] N. Chamberlain, J. Chen, P. Focardi, R. Hodges, R. Hughes, J. Jakoboski, J. Venkatesan, M. Zawadzki, "Juno Microwave Radiometer Patch Array Antennas," IEEE Antennas and Propagation Society International Symposium, AP SURSI'09, 2009.

The invention claimed is:

1. An antenna comprising:

a metal top ground plane;

a patch array arranged above the top ground plane, the patch array comprising a plurality of single patch elements made from metal, wherein each single patch element of the plurality of single patch elements comprises:

a flat radiation surface element having a rectangular shape into which a rectangular cutout is formed;

an RF power feed point comprising a first cylindrical structure that contacts at one end of the first cylindrical structure a bottom side of the flat radiation surface element, and feeds through a corresponding hole formed in the metal top ground plane for connection to the RF power at a second end of the first cylindrical structure; and a structural post comprising a second cylindrical structure that contacts at one end of the second cylindrical structure the bottom side of the radiation surface element at a region of the radiation surface element where an electric surface current is substantially smaller compared to an electric surface current in other regions of the radiation surface element, and contacts the top ground plane at a second end of the second cylindrical structure.

2. The antenna according to claim 1, wherein each single patch element is made as a single machined block that is suspended above the top ground plane via the structural post.

3. The antenna according to claim 2, wherein the single patch element and the top ground plane are made of a same metal.

4. The antenna according to claim 1, wherein dimensions of a length and a width of the rectangular shape of the radiation surface element are based on a free space wavelength at a frequency of operation of the antenna.

5. The antenna according to claim 4, wherein a length, defined by parallel first and second sides, and a width, defined by parallel third and fourth sides, of the radiation surface element are each in a range between 40% and 60% of the free space wavelength.

6. The antenna according to claim 5, wherein a thickness of the radiation surface element is in a range between 0.9 mm to 1.1 mm.

7. The antenna according to claim 5, wherein the rectangular cutout longitudinally extends along a width of the radiation surface element from an edge of the first side of the radiation surface element toward an edge of the second side of the radiation surface element.

8. The antenna according to claim 7, wherein the rectangular cutout has a long side with a length that is in a range between 40% and 70% of the width of the radiation surface.

9. The antenna according to claim 8, wherein the rectangular cutout has a short side with a length that is in a range between 15% and 35% of the length of the radiation surface.

10. The antenna according to claim 7, wherein the rectangular cutout is arranged at a distance from an edge of the third side of the radiation surface element that is in a range between 15% and 35% of the length of the radiation surface.

11. The antenna according to claim 7, wherein the first cylindrical structure is centrally arranged between an edge of the rectangular cutout and an edge of the third side, and at a distance from an edge of the first side of the radiation surface element that is in a range between 10% and 30% of the width of the radiation surface.

12. The antenna according to claim 11, wherein a diameter of the first cylindrical structure is in a range between 0.8 mm to 1.2 mm.

13. The antenna according to claim 7, wherein the second cylindrical structure is centrally arranged between an edge of the first side and an edge of the second side, and centrally arranged between an edge of the fourth side and an edge of the rectangular cutout.

14. The antenna according to claim 13, wherein a diameter of the second cylindrical structure is in a range between 4.5 mm to 5.5 mm.

15. The antenna according to claim 13, wherein a diameter of the second cylindrical structure is at least 10% of the width or the length of the radiation surface element.

16. The antenna according to claim 7, wherein a height of the second cylindrical structure is selected to provide a bandwidth of the antenna.

17. The antenna according to claim 1, further comprising:

a metal bottom ground plane; and an air stripline feed network that is arranged between the top ground plane and the bottom ground plane, wherein RF power to the air stripline is provided through a single connection, and wherein the air stripline is configured to provide the RF power to each single patch element of the plurality of single patch elements through a connection to a respective RF power feed point.

18. The antenna according to claim 17, wherein the top ground plane and the bottom ground plane each have a thickness in range between 1.25 mm and 1.75 mm.

19. The antenna according to claim 17, wherein the single patch element, the top ground plane, and the bottom ground plane are made of a same metal.

20. The antenna according to claim 1, wherein a distance between any two adjacent single patch elements of the plurality of single patch elements is based on a free space wavelength at a frequency of operation of the antenna.

21. The antenna according to claim 20, wherein the distance between any two adjacent single patch elements of the plurality of single patch elements is in a range between 35% and 75% of the free space wavelength.

22. A dual-band circularly polarized antenna for operation at an uplink frequency in a range between 7.145 GHz and 7.190 GHz, and at a downlink frequency in a range between 8.40 GHz and 8.45 GHz, comprising:

the antenna according to claim 1, wherein the plurality of single patch elements comprises 32×32 single patch elements arranged as an array of equidistantly positioned single patch elements, wherein each of a length and a width of the radiation surface element is in a range between 1.4 cm and 2.1 cm.

23. The dual-band circularly polarized antenna according to claim 22, wherein a spacing between any two adjacent single patch elements of the 32×32 single patch elements is in a range between 1.26 cm and 2.7 cm.

24. The dual-band circularly polarized antenna according to claim 22, wherein the array of equidistantly positioned single patch elements comprises four panels that are linked via hinges to allow folding of the array.

25. A method for producing an antenna, the method comprising:

providing a metal top ground plane; and providing a patch array comprising a plurality of single patch elements made from metal;

arranging the patch array above the top ground plane via contacting of a respective structural post of each single patch element of the plurality of single patch elements to the top ground plane, wherein, each single patch element of the plurality of single patch elements comprises:

a flat radiation surface element having a rectangular shape into which a rectangular cutout is formed;

an RF power feed point comprising a first cylindrical structure that contacts at one end of the first cylindrical structure a bottom side of the flat radiation surface element, and feeds through a corresponding hole formed in the metal top ground plane for connection to the RF power at a second end of the first cylindrical structure; and the structural post comprising a second cylindrical structure that contacts at one end of the second cylindrical structure the bottom side of the radiation surface element at a region of the radiation surface element where an electric surface current is substantially smaller compared to an electric surface current in other regions of the radiation surface element, and contacts the top ground plane at a second end of the second cylindrical structure.

* * * * *